US011306717B2

(12) United States Patent
Mendoza et al.

(10) Patent No.: US 11,306,717 B2
(45) Date of Patent: Apr. 19, 2022

(54) CO-ROTATIONAL SCROLL MACHINE

(71) Applicant: ECOLE POLYTECHNIQUE FÉDÉRALE DE LAUSANNE, Lausanne (CH)

(72) Inventors: Luis Mendoza, Neuchâtel (CH); Jürg Schiffmann, Bern (CH)

( * ) Notice: Subject to any disclaimer, the term of this patent is extended or adjusted under 35 U.S.C. 154(b) by 266 days.

(21) Appl. No.: 16/961,748

(22) PCT Filed: Jan. 17, 2018

(86) PCT No.: PCT/IB2018/050278
§ 371 (c)(1),
(2) Date: Jul. 13, 2020

(87) PCT Pub. No.: WO2018/134739
PCT Pub. Date: Jul. 26, 2018

(65) Prior Publication Data

US 2021/0062807 A1 Mar. 4, 2021

(30) Foreign Application Priority Data

Jan. 17, 2017 (WO) ..... PCT/IB2017/050240

(51) Int. Cl.
*F03C 2/00* (2006.01)
*F03C 4/00* (2006.01)
(Continued)

(52) U.S. Cl.
CPC ..... *F04C 18/023* (2013.01); *F04C 29/0057* (2013.01); *F04C 23/008* (2013.01); *F04C 29/0007* (2013.01)

(58) Field of Classification Search
CPC .. F04C 18/023; F04C 23/008; F04C 29/0007; F04C 29/0057; F04C 29/042; F01C 1/023; F01C 17/066; F01C 21/001; F16D 3/04
See application file for complete search history.

(56) References Cited

U.S. PATENT DOCUMENTS 4,911,621 A * 3/1990 McCullough ..... F01C 17/066 418/55.3
4,954,056 A * 9/1990 Muta ..... F01C 17/066 418/55.3
(Continued)

FOREIGN PATENT DOCUMENTS

DE 19528071 A1 * 2/1997 ..... F04C 18/023
FR 55178 E * 10/1951 ..... F01C 17/066
(Continued)

*Primary Examiner* — Theresa Trieu
(74) *Attorney, Agent, or Firm* — Zarley Law Firm P.L.C.

(57) ABSTRACT

A co-rotating scroll machine operable as compressor or expander, comprises a transmission and guidance mechanism for first and second scroll plates, having three transmission and guidance units uniformly distributed around the scroll plates towards the periphery thereof. Each transmission and guidance unit comprises a male element mounted on one of the scroll plates and a facing female element mounted on the facing scroll plate. Each transmission and guidance unit comprises an internal ring mounted for angular displacement in the opening of the female element, the internal ring having therein a slot wherein the male element of the transmission and guidance unit slides. The male of the three transmission and guidance units are supported and guided by respective support elements on a common external guide ring. A liquid injection system comprises a liquid channel which is connected with bleed holes.

13 Claims, 9 Drawing Sheets

(51) Int. Cl.

| | |
|---|---|
| ***F04C 2/00*** | (2006.01) |
| ***F04C 18/00*** | (2006.01) |
| ***F04C 18/02*** | (2006.01) |
| ***F04C 29/00*** | (2006.01) |
| *F04C 23/00* | (2006.01) |

(56) References Cited

U.S. PATENT DOCUMENTS 5,037,280 A * 8/1991 Nishida ..... F01C 17/066 418/55.3
5,090,876 A * 2/1992 Hashizume ..... F01C 17/066 418/55.3
5,178,526 A * 1/1993 Galante ..... F01C 17/066 418/55.3
5,199,280 A * 4/1993 Riffe ..... F01C 17/066 418/55.3
5,447,420 A * 9/1995 Caillat ..... F04C 18/0215 418/55.5
5,713,731 A * 2/1998 Utter ..... F04C 18/0215 418/55.5
6,062,833 A * 5/2000 Holzapfel ..... F01C 17/066 418/55.3
6,368,065 B1 * 4/2002 Hugenroth ..... F01C 17/066 418/55.3
2002/0182094 A1 * 12/2002 Mori ..... F01C 17/066 418/55.3
2008/0240957 A1 * 10/2008 Yanagisawa ..... F04C 18/0215 418/55.5
2012/0288393 A1 * 11/2012 Sato ..... F01C 17/066 418/55.3

FOREIGN PATENT DOCUMENTS

JP 04091384 A * 3/1992 ..... F04C 18/023
JP 04121486 A * 4/1992 ..... F04C 18/023
KR 100699226 B1 * 3/2007 ..... F04C 18/0215

* cited by examiner

CO-ROTATIONAL SCROLL MACHINE

CROSS REFERENCE TO RELATED APPLICATIONS

This application corresponds to PCT/IB2018/050278 filed on 17 Jan. 2018; Which is incorporated herein by reference in its entirety.

FIELD OF THE INVENTION

The present invention relates to a co-rotational scroll machine operable as compressor or expander, and in particular is concerned with a non-hyper static transmission/guidance mechanism for connecting two scroll members in co-rotational or orbiting motion and that allows operation with a radial compliance system.

BACKGROUND

The working principle of the co-rotating scroll concept is based on two scroll involutes which are rotating in the same direction and at the same rotor speed with an off-set center of rotation. In contrast to the orbiting concept, both scrolls experience a pure rotational motion and therefore offer the possibility to achieve very low levels of mechanical vibration and noise compared to the orbiting concept. Co-rotational scroll technology is illustrated for example in U.S. Pat. No. 5,713,731 A.

The main challenge of co-rotating technology is the requirement of an accurate mechanical synchronization of the two scrolls since any angular deviation could block or damage the machine. Several attempts to find a suitable transmission mechanism are found in the literature. They are mainly classified according to the location where the rotational motion is applied, either by external transmission elements (like two belts, two gears, or two very well synchronized motors) or by means of an internal transmission system which keeps the relative motion between the two scrolls.

By using external transmission elements, different challenges related to the proper synchronization, cost and size are found. This is described in a paper "Testing and modelling of a novel oil-free co-rotating scroll machine with water injection" by Mendoza L C, Lemofouet-Gatsi S, Schiffmann J., Appl Energy 2016. These drawbacks of external transmission elements could be minimized or eliminated by using an internal transmission system provided with a feasible and competitive co-rotating machine.

Different types of internal transmission systems for co-rotating machines have been proposed. They are based on Oldham technology (U.S. Pat. No. 5,037,280 A, Scroll fluid machine with coupling between rotating scrolls), crankshafts (U.S. Pat. No. 4,954,056 A, Scroll machine with pin coupling), internal gears (U.S. Pat. No. 4,911,621 A, Scroll fluid device using flexible toothed ring synchronizer), or a plurality of interdigital vanes (U.S. Pat. No. 5,199,280 A, Co-rotational scroll compressor supercharger device). However inherent challenges with centrifugal forces, hyperstatism and two phase compression/expansion tolerance are still not solved. These challenges lead to machine failure.

U.S. Pat. No. 5,447,420 A: Scroll compressor with liquid injection, discloses internal liquid injection in an orbiting scroll machine. Liquid is injected in a fixed spiral by bleed holes placing a first intermediate chamber in communication with a source of refrigerant at pressure. In co-rotating machines the two spirals are rotating, therefore, the liquid is injected by bleed holes in only one spiral. This spiral communicates with a liquid high pressure source, which is pumped through internal pipes inside the spiral plate.

US Patent 2012288393A1; Spiral compressor, discloses a co-rotational scroll machine with a positive guidance arrangement between scroll plates. The positive guidance arrangement includes support rollers, preferably angularly-offset from one another by 120°, that are engaged and constrained to roll in cylindrical bores in a compression crown (female element). By these measures, both spirals carry out orbital movements with respect to each other, as a result of the offset of their axes and under the guidance provided by the support rollers that roll around the inner circumference of the bores. However, the proposed transmission/guidance system does not allow a freedom of degree in a radial direction between the two scroll, i.e. a male element/pin engages without play in a female element.

US Patent publication 20020182094 A1 discloses a co-rotational scroll machine with a transmission unit between a drive scroll and a driven scroll. This mechanism comprises four pins at 90° which each permanently engage in a rotatable ring.

DE19528071 discloses a spiral compressor with cam followers on the back of one scroll plate providing a guidance-only function by rollers that extend in corresponding bores.

FR55178E discloses a rotational scroll-type machine with pins on one scroll engaging without play in bores in the other scroll.

KR100699226 B1 discloses a rotational scroll machine which implicitly is of a type covered by the pre-characterizing clause of claim 1, in which guide pins on one scroll engage in slots in the other scroll.

SUMMARY OF THE INVENTION

Therefore a new transmission/guidance system which allows connecting the two scroll members in co-rotational or orbiting motion and handles centrifugal forces, hyperstatism and allows a radial compliance freedom of degree is proposed.

The objective of the present invention is to provide a co-rotational type of scroll machine with a transmission/guidance system which allows the rotation of two scrolls in the same direction and at the same rotor speed around offset axes with/without lubrication and which ensures synchronization of the two scrolls, even at high rotor speed or high torque. Moreover, with the proposed transmission/guidance system, wear of the different components is reduced due to the absence of frictional engagement or meshing. Scroll plate unbalancing, components misaligning and manufacturing errors are handled by free engagement of the transmission. This free engagement avoids hyperstatism in the machine. By means of this invention, disadvantages found in the prior art are overcome and additional advantages are achieved.

The invention has been conceived for a co-rotational scroll compressor/expander but it also could be used in a scroll orbital machine since the relative motion is the same in both technologies. The machine is composed of a housing, two pairs of bearings supported in the housing with first and second spindles with radially offset axes. A first spindle drives the second one through the scroll plate which holds the first three transmission elements, which are engaged to the second three elements which are allocated in the second scroll plate.

More precisely, according to the invention there is provided a co-rotational scroll machine operable as compressor or expander, of the type comprising: a housing; bearings supported in opposite parts of the housing that are laterally offset from one another; first and second parallel spindles rotationally supported by the bearings, the first and second spindles extending inwardly of the housing to respective inner ends that are axially spaced-apart from one another and are located adjacent to but laterally offset to one another; facing superimposed first and second scroll plates mounted transversally on the respective inner ends of the first and second spindles at locations in the vicinity of but spaced from respective centers of the scroll plates; and a transmission and guidance mechanism for the first and second scroll plates.

The transmission and guidance mechanism comprises three transmission and guidance units uniformly distributed around the scroll plates towards the periphery thereof. Each transmission and guidance unit comprises a male element mounted on one of the scroll plates and a facing female element mounted on the facing scroll plate, wherein the radial distances from the center of each scroll plate to the center of each transmission and guidance unit are equidistant. Moreover, the male element of each transmission and guidance unit is received in an opening in the corresponding female element with a play allowing relative rotational movement of the two scroll plates in response to rotation of one of the scroll plates by one of the spindles at eccentricity values from 0 to a maximum eccentricity $\delta_{max}$.

Each transmission and guidance unit comprises an internal ring mounted for angular displacement in the opening of the female element, the internal ring comprising therein an opening usually a slot, and wherein the male elements of the transmission and guidance unit engage for limited movement in the opening/along the slot of the angularly-displaceable internal ring. When the opening in the internal rings is a slot, the male elements of the guidance ring are in principle engaged in one extreme of the internal ring's slots.

According to the invention, the three male elements of the three transmission and guidance units are supported and guided by three respective support elements that are located spaced apart on a common rotatable guide ring that is mounted externally of the scroll plates for rotation with the scroll plates about an axis which is parallel to the first and second spindles and which is radially offset at the maximum scroll eccentricity. In this way, each male element of the three transmission and guidance units is supported and guided by its support element on the guide ring during limited movement of the male element in the opening of the angularly-displaceable internal ring.

Usually, the three support elements are located at the outer ends of three equal arms extending radially outwardly from the rotatable guide ring and disposed in correspondence with the three transmission and guidance units. In this case, the three support elements can be terminal parts of elongate members that project from the outer ends of the three arms and are disposed parallel to the axis of rotation.

Advantageously, the male element of each transmission and guidance unit comprises a roller mounted on the end of an elongate member.

In simple terms, a rotatable guide ring has three arms/legs and on the tip of the arms/legs three cam followers are provided for guidance proposes. The guide ring is supported in the chassis but radially offset at the maximum scroll eccentricity ($\delta_{max}$).

Thus, the guide ring is used to guarantee parallelism between the three internal rings. Cam followers positioned on the arm tips of the guide ring can be inserted in the internal rings. The guide ring is usually supported on a rotary bearing which is offset to the center of rotation of the nearest scroll plate.

Typically, three pairs of transmission units (male, female elements are equally distributed at 120° to one another (as in U.S. Pat. No. 6,062,833 A), with the radial distances from the center of the scroll plate to the center of each unit equidistant. The three transmission units are associated with a common external guide ring.

The transmission and guidance units can be located partly in corresponding projections that project from the periphery of generally circular scroll plates like projecting ears.

Preferably, the female element of each transmission and guidance unit comprises a cylindrical housing attached to one scroll plate, in which cylindrical housing the internal ring is mounted for angular displacement relative to an inner cylindrical surface of the cylindrical housing. The internal ring can be mounted in the cylindrical housing by a bearing, for example a roller bearing or a ball bearing.

The internal ring is preferably made foraminate to make it lightweight and to reinforce it.

This internal ring can for example comprise a radial-inwardly directed slot extending inside the internal ring from its outer periphery and extending over part of the width of the internal ring, this radial-inwardly directed slot being enclosed by a boundary wall integral with the internal ring, the internal ring further comprising a foraminate reinforcing structure that occupies the space between the inner periphery of the internal ring and the boundary wall of the radial-inwardly directed slot.

Preferably, the center-to-center spacing of the scroll plates is coordinated with the displacement of the male elements in the slots of the internal rings in the female elements in such a way as to maintain said internal rings such that their slots all remain parallel to one another during rotation of the scroll plates.

Also preferably, the male elements of the transmission and guidance units comprise rollers mounted with one rotary degree of freedom forming rotatable cam followers that engage in the slots of the internal rings inside the female elements.

Each male transmission element is preferably composed of a cam follower and follower housing.

Moreover when the machine operates at a non-constant center difference ($\Delta\delta$), the guide ring guarantees that the slots remain parallel to one another during rotation of the scroll plates.

As mentioned, each female transmission element preferably has a lightweight in particular foraminate internal ring to overcome centrifugal forces, and this internal ring can be held by a rotational bearing which is supported on the transmission unit's housing.

Counterweights are preferably provided on the back sides of the scroll plates to balance and equilibrate the mass.

An internal pipe inside a scroll plate is used to inject liquid through some bleed holes. The liquid is injected in the intermediates chambers. In this arrangement, one scroll plate is built without a discharge port and with an internal channel connected on one side to a shaft in the spindle and on the other side to several bleed holes leading to compression/expansion chambers defined between the scroll plates, this arrangement enabling a controlled injection of a stream of pressurized liquid inside the chambers during compression and expansion operations to perform 2-phase, almost-isothermal compression/expansion processes.

DETAILED DESCRIPTION

Figure 1:
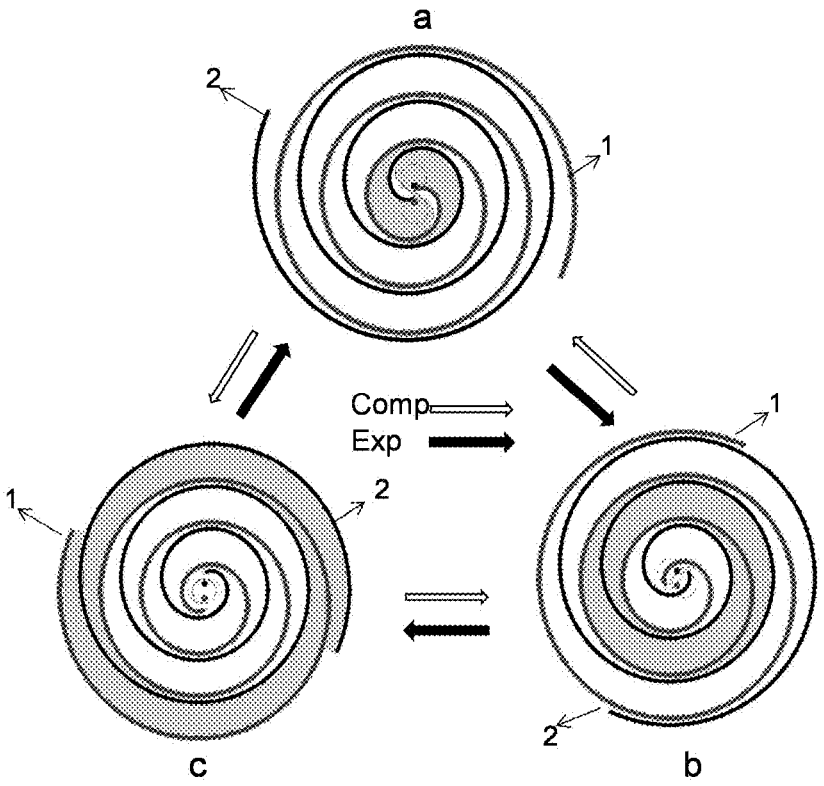
PRIOR ART Fig. 1
FIG. 1 shows the working principle of a co-rotating scroll machine.

FIG. 1 schematically illustrates the working principle of a co-rotating scroll machine. Two scroll involutes 1,2 are shown in three positions a, b and c. The scroll involutes 1,2 rotate in the same direction of rotation at the same rotor speed and with an off-set center of rotation. Operating as expander: vapor enters by suction ports in the center of the spirals and fills the suction chamber (position a). After that, both spirals rotate and increase the volume of the suction chamber (position b) and create an expansion chamber. Finally the fluid is expanded until the maximum volume generated by the two spirals (position c), and the fluid is discharged. Operation as compressor is the same as expander but in reverse mode.

Figure 2:
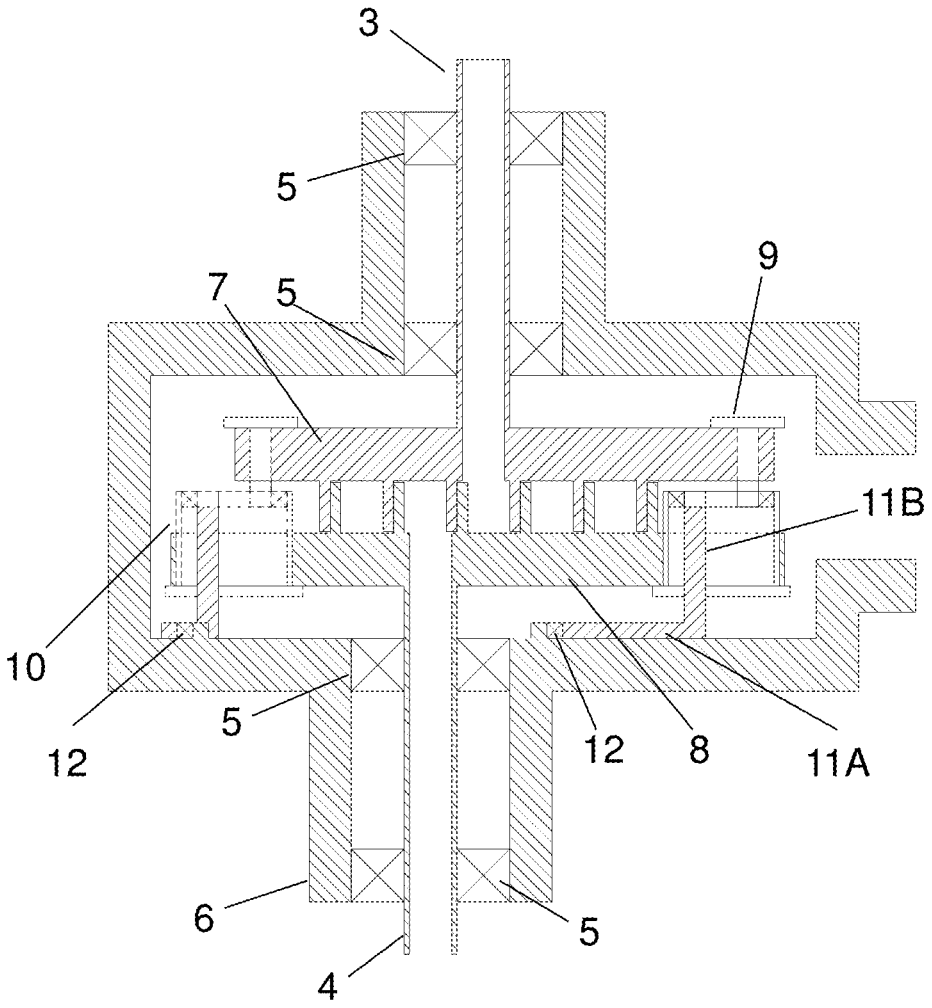
FIG. 2 is a partial cross section of an embodiment of the present invention in an otherwise conventional co-rotating scroll machine.

FIG. 2 shows an embodiment of the scroll machine according to the invention As shown, two offset spindles (3,4) are supported on two pairs of rotational bearings (5) which are held in laterally-offset opposite parts of a chassis (6). One scroll plate (8) is fixed to the driver spindle (4) and transmits motion to the offset scroll plate (7) by three pairs of female (10) and male (9) transmission subsystems. A guide ring (11), of which FIG. 2 shows one arm (11A) and one projection (11B), is supported on a rotational bearing (12). The guide ring (11) supports three radial arms (11A) each with an axial projecting/elongated rod (11B) (see also FIG. 5).

Figure 3:
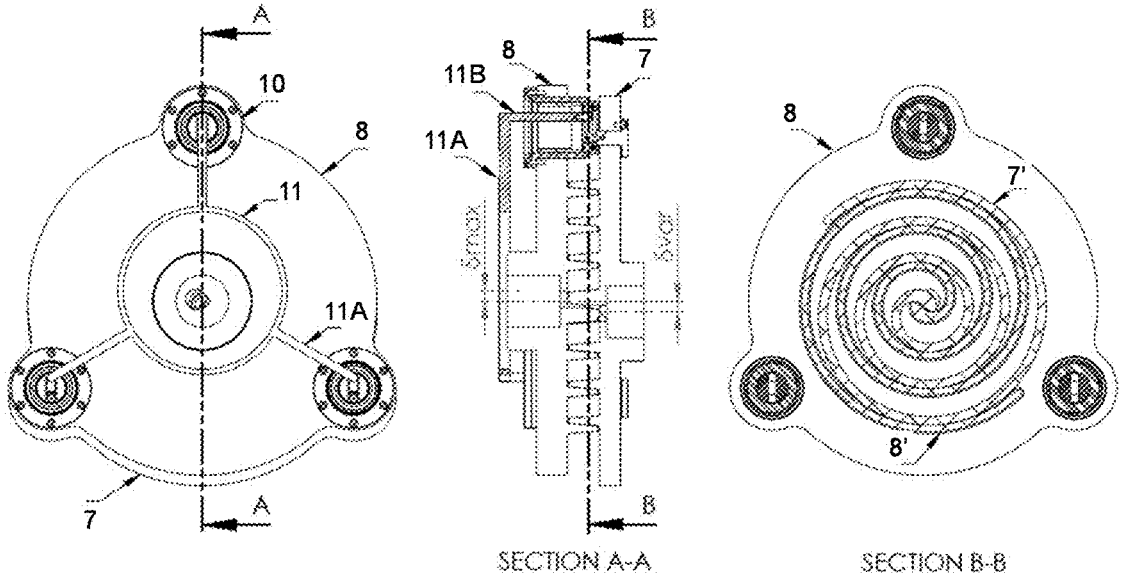
FIG. 3 shows three views: a front view of a scroll plate with its transmission and guidance units and guide ring; a cross-section along line A-A of the front view; and a across-section along line B-B of the front view.

As is usual, the scroll plates (7,8), which are superimposed and are co-extensive, carry on their facing faces, scrolls (7',8') which can be involutes or Archimedes spirals (FIG. 3). As known, during co-rotation of the scroll plates (7,8) relative movement of the scrolls forms a plurality of moving fluid compression or expansion spaces for compressing or expanding a fluid as explained in connection with FIGS. 1 and 4.

Figure 4:
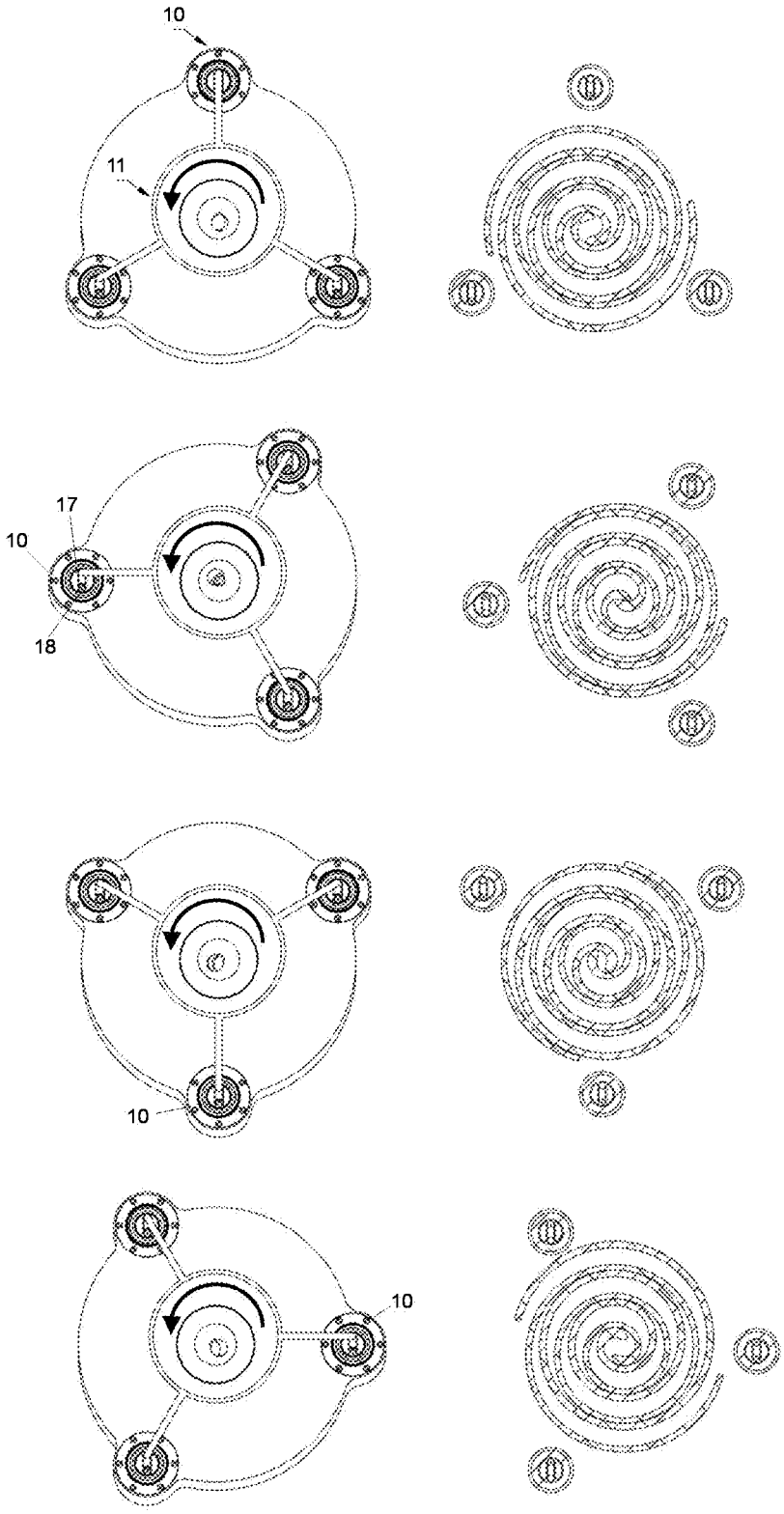
FIG. 4 shows the positions of the transmission and guidance units and of the scroll during one entire revolution, at 90° intervals.

FIG. 4 shows the positions of the transmission and guidance units and of the scroll during one entire revolution, at 90° intervals, i.e. one transmission unit 10 is shown at 0°, 90°, 180° and 270° with the scrolls shown in their corresponding positions. As can be seen, during rotation, the three slots (18) in the internal rings of the female guidance units 10 remain parallel at all times. This is due to the constraint imposed by the three cam followers of the guide ring (11), as described below. This feature allows transmitting the motion to the offset scroll plate independently on its radial position.

Figure 5:
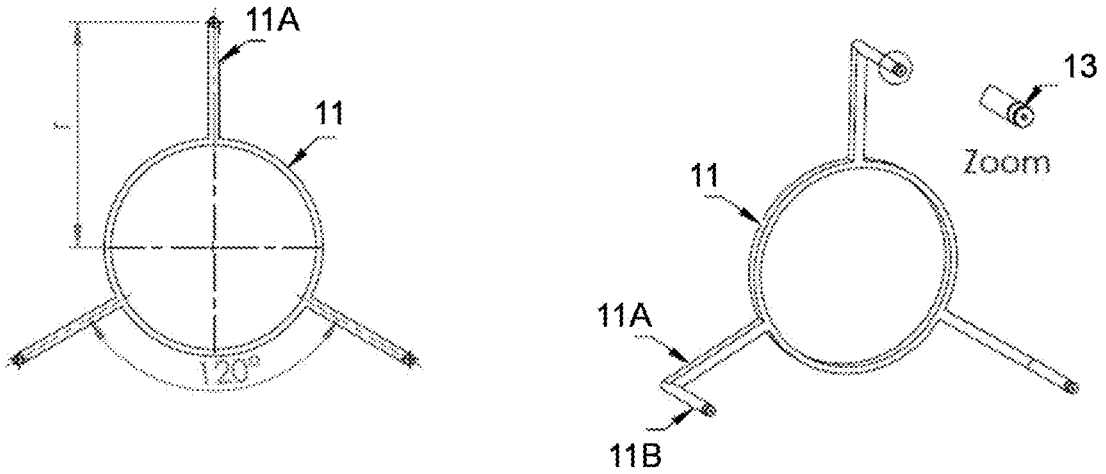
FIG. 5 shows in front view and perspective a guide ring.

FIG. 5 shows a guide ring 11 for three transmission and guidance units (9,10) located at 120° to one another. For this the guide ring (11) has three outwardly-projecting arms 11A at 120°. The guide ring (11) is open at its center and its diameter corresponds to that of the bearing (12) (FIG. 1). When installed, the center of the guide ring (11) is offset by the maximum scroll eccentricity ($\delta_{max}$). For this, the support ring (11) is offset relative to the closest scroll plate, namely scroll plate (8), by an amount which corresponds to the maximum eccentricity ($\delta_{max}$) of the other scroll plate, namely scroll plate (7). At the outer ends of arms (11A) are three elongate rods (11B) that project parallel to the axis of rotation. The terminal ends of these projecting rods (11B) carry support elements (13) that can be in the form of rollers (14) forming cam followers for engaging in slots (18) in the female guide elements (10).

Figure 6:
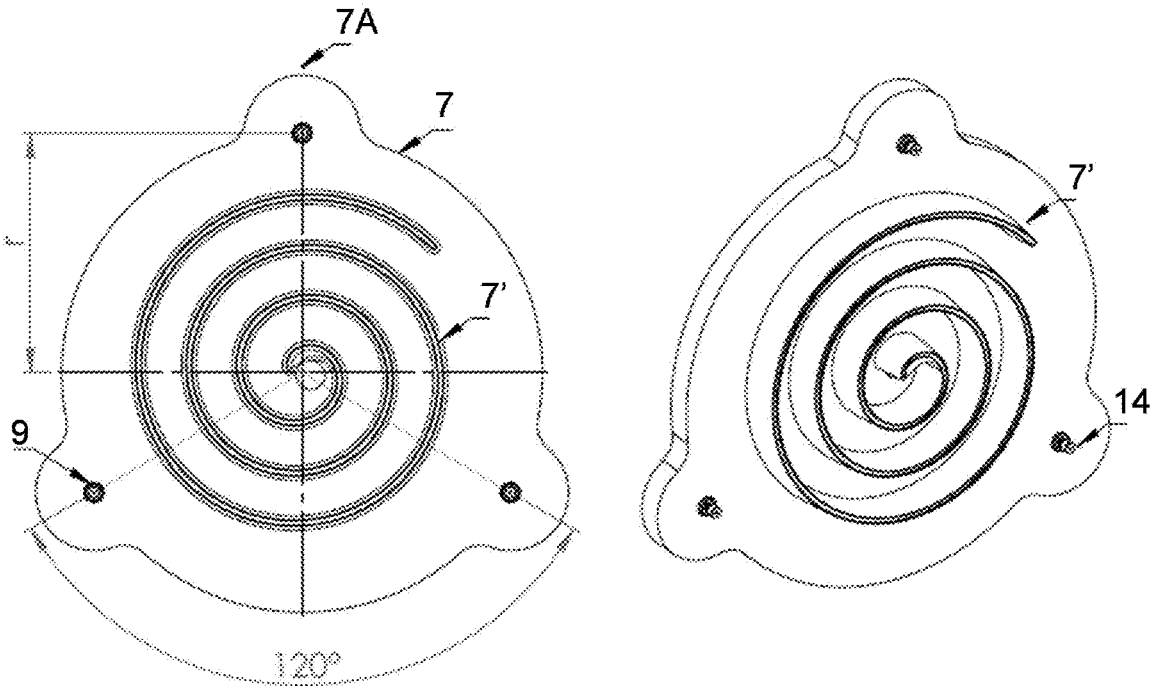
FIG. 6 shows in front view and perspective a scroll plate with male transmission elements.
Figure 7:
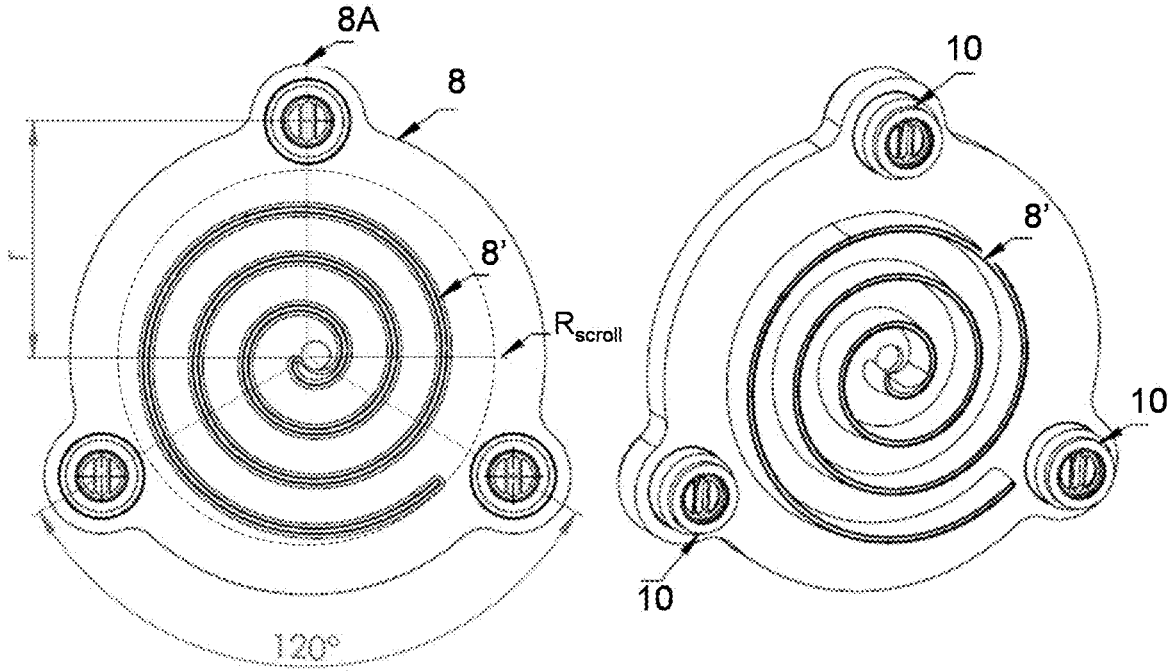
FIG. 7 shows in front view and perspective a scroll plate with female transmission elements.

As shown in FIGS. 6-7, the transmission and guidance units (9,10) are located partly in three corresponding projections that project from the periphery of generally circular scroll plates (7,8) like projecting ears.

The transmission subsystems (male (9), female (10)) and guide ring (11) are positioned at given radial distances (r, as seen in FIG. 5-7) from the centers of the scroll plates (7,8) and they are separated by 120° one with respect to each other. The given radial distances (r) are a function of the external radius of the female transmission subsystems (10) and the maximum scroll tip trajectory ($R_{scroll}$)(FIG. 7).

Figure 8:
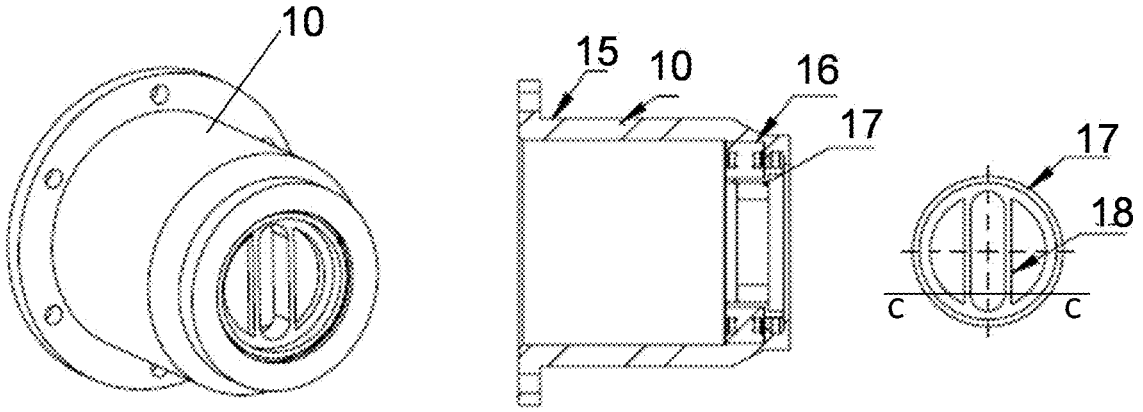
FIG. 8 is a perspective view and a schematic cross-sectional view of a female transmission element, and a detail of an embodiment of a lightweight internal ring.
Figure 9:
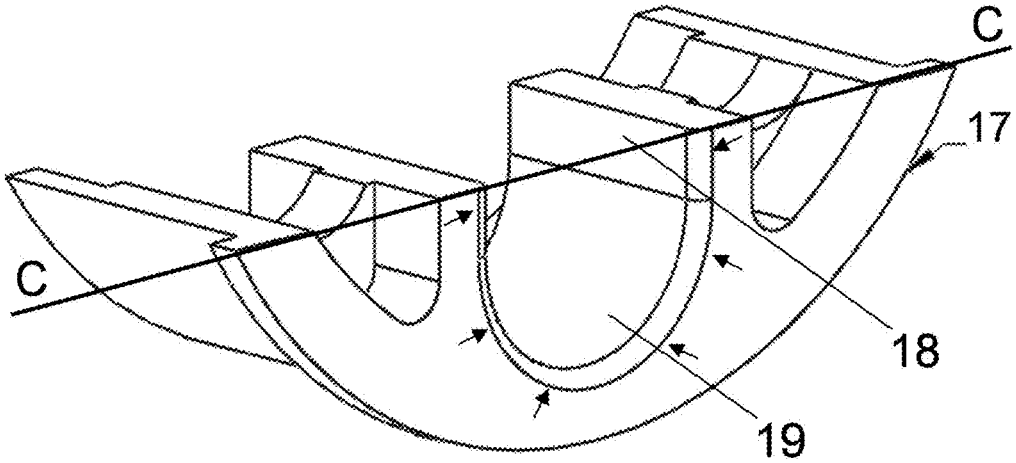
FIG. 9 is a partial view in cross-section along line C-C of FIG. 8, of part of a lightweight inner ring illustrating how force/reaction is transmitted to a cam follower.
Figure 10:
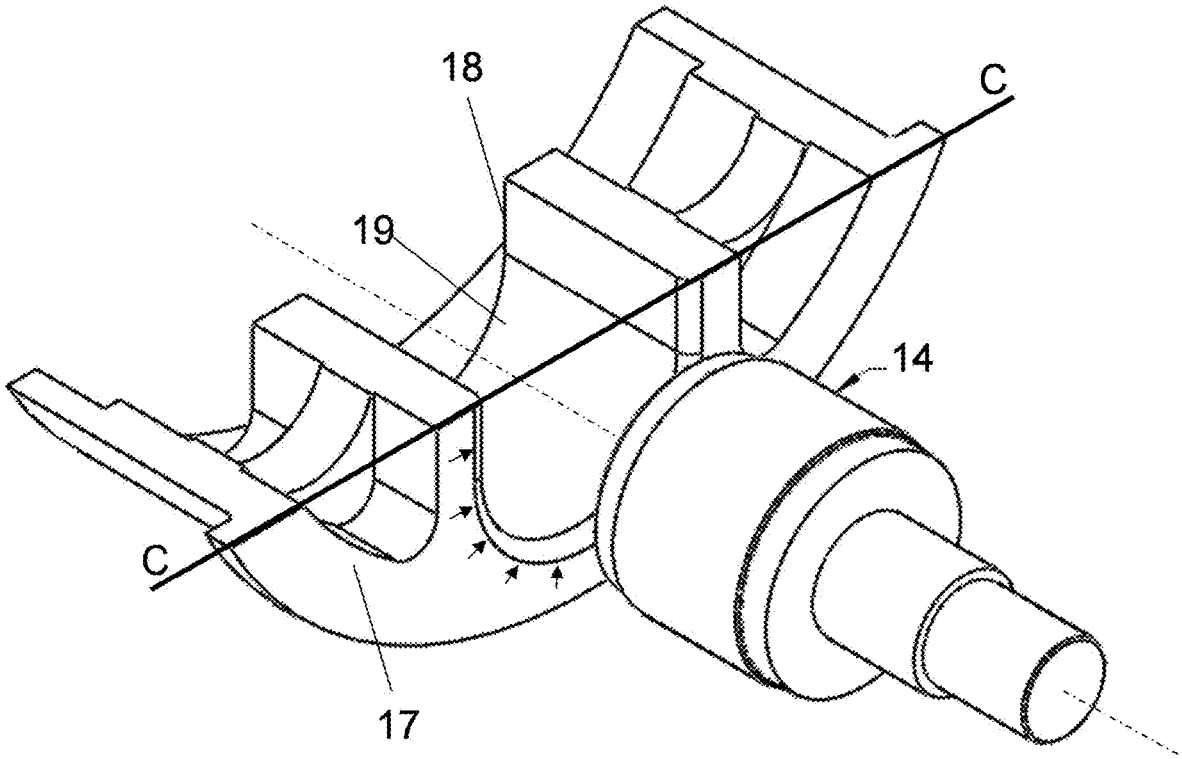
FIG. 10 is a partial perspective view showing the engagement of a cam follower into the lightweight internal ring.

The male transmission subsystems (9/14) are inserted in slots (18), FIGS. 8, 9 and 10, of the female transmission subsystems (10). This engagement allows the rotation of cam followers (14), FIG. 8, and internal lightweight rings (17), FIGS. 9 and 10, around their axis. This rotation allows the offset rotational motion of the two scroll plates and causes an orbiting relative motion between the two scroll plates (7,8).

The width of the slots (18) and the diameter of the cam followers (14) are the same, see FIGS. 9 and 10. The lengths of the slots (18) are determined by the center difference ($\delta_{max}$) (FIG. 11) of the scroll plates (7,8) and the radius of the cam follower (14).

The cam followers (14) engagement of the guide ring (11) and the slots (18) fixes the position of the lightweight inner rings (17) during the scroll plates rotation, and maintains parallelism between the three slots (18) (FIG. 4).

FIG. 8 shows an embodiment of the female transmission subsystem (10). A cylindrical housing (15) holds a rotational bearing (16) in which the lightweight inner ring (17) is supported with one rotary degree of freedom. The housing (15) is inserted from the back of scroll plate (8).

As shown in FIG. 8, the lightweight disc-like internal ring (17) contains a slot (18) disposed in its middle. This radial-inwardly directed slot (18) extends inside the ring (17) from the outer periphery of the ring and extending over a substantial part of the width of the ring (17). This radial-inwardly directed slot (18) is enclosed by a boundary wall integral with the internal ring (17).

FIGS. 9 and 10 show the free linkage between the internal ring (17) and its cam follower (14). This free linkage is achieved by the slot (18) with a curved lower part (19) that receives the cam follower (14).

Figure 11:
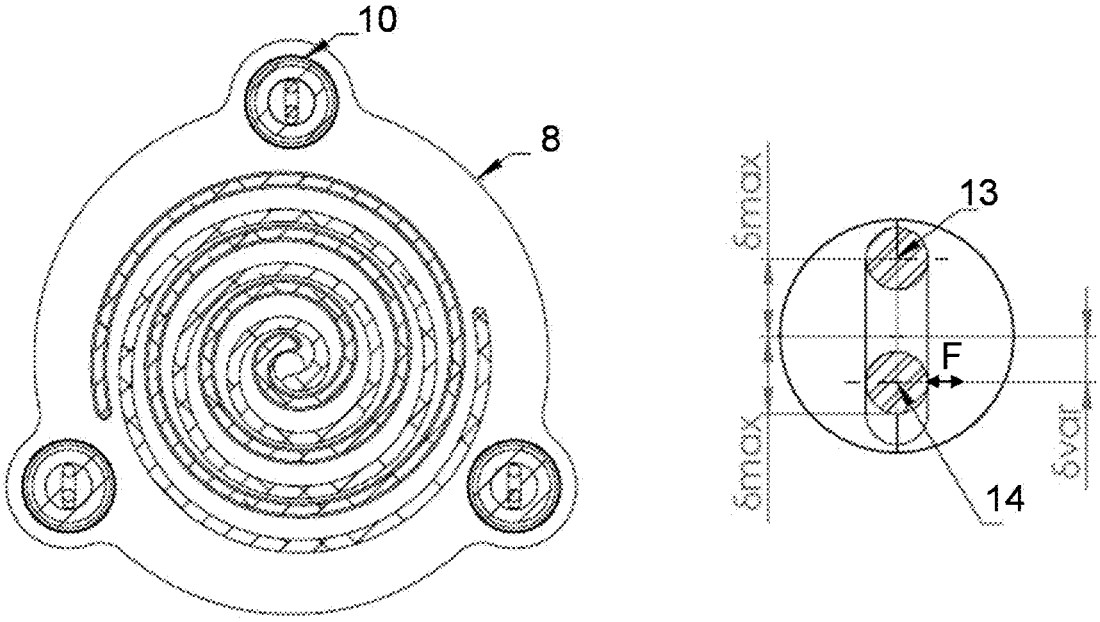
FIG. 11 shows the positions of the male transmission elements and cam follower of the guide ring at maximum and smaller nominal center differences ($\delta_{var}<\delta_{max}$)

In case the transmission operates at a smaller center difference as seen in FIG. 11, the guide ring (11) through the cam followers (14) constraints parallelism between the three internal rings (17). The cam followers (14) are inserted at maximum eccentricity distance in the top of the three slots (18).

FIG. 11 shows a cross section view of the two scrolls and the engagement of the transmission sub-systems. The transmission sub-systems are engaged by the cam followers (13) of the guide ring at the maximum eccentricity distance ($\delta_{max}$), and the cam followers (14) of the scroll plate (7) are inserted in the slots. The transmission forces (F) are radially transmitted only in one point between the cam followers and the inner rings.

Figure 12:
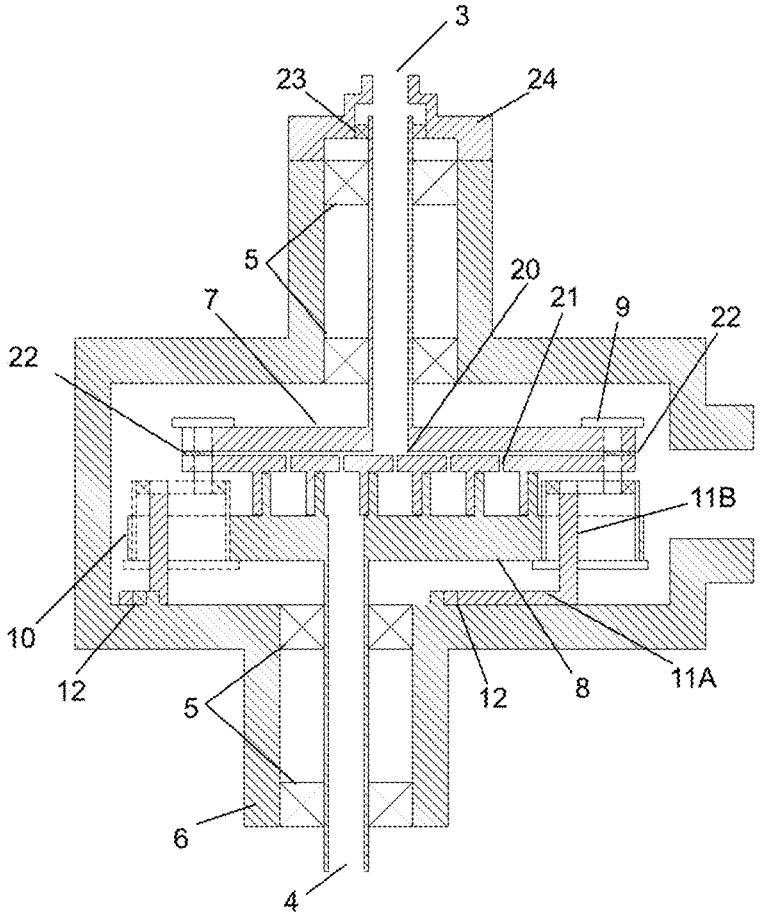
FIG. 12 is a partial cross section of an embodiment of the present invention operating with water injection.

FIG. 12 shows an embodiment of the scroll machine with internal water injection. Water is injected through only one scroll plate (7), which is built without discharge port (as a compressor). An internal channel (20) inside the scroll plate (7) connects a shaft in spindle (3) with several bleed holes (21). A stream of pressurized liquid delivered through the shaft in spindle (3) passes through the internal channel (20) and a gap provided by spacers 22 from where it is ejected by the bleed holes (21). To set the liquid flow rate injected in each chamber, the diameters of the bleed holes (21) are determined to reach choke conditions. In compressor mode, dry vapor enters through the scroll periphery, then the vapor and liquid are pressurized by the two scrolls, and finally discharged by the driven spindle (4). In compression mode, the heat transfer process between the dry vapor and the liquid follow a counter flow path. In expansion mode, dry vapor enters by the driven spindle (4), the vapor is expanded to the periphery and finally discharged to the housing. The dry vapor transfers heat during expansion with the liquid injected in the different chambers.

Of course, with the described co-rotational scroll machine, instead of using the spindle 3 as the drive spindle, the spindle 4 could be used as drive spindle.

The invention claimed is:

1. A co-rotating scroll machine operable as compressor or expander, comprising:

a housing (6);

bearings (5) supported in opposite parts of the housing that are laterally offset from one another, first and second parallel spindles (3,4) rotationally supported by the bearings, the first and second spindles extending inwardly of the housing to respective inner ends that are axially spaced-apart from one another and are located adjacent to but laterally offset to one another;

facing superimposed first and second scroll plates (7,8) mounted transversally on the respective inner ends of the first and second spindles at locations in the vicinity of but spaced from respective centers of the scroll plates; and a transmission and guidance mechanism (9,10,11) for the first and second scroll plates;

wherein the transmission and guidance mechanism comprises three transmission and guidance units (9,10) uniformly distributed around the scroll plates towards the periphery thereof, each transmission and guidance unit comprising a male element (9) mounted on one of the scroll plates and a facing female element (10) mounted on the facing scroll plate, wherein the radial distances from the center of each scroll plate (7,8) to a center of each transmission and guidance unit (9,10) are equidistant;

the male element (9) of each transmission and guidance unit (9,10) being received in an opening of the corresponding female element (10) with a play, allowing relative rotational movement of the two scroll plates (7,8) at eccentricity values from 0 to a maximum eccentricity σmax, wherein each transmission and guidance unit (9,10) comprises an angularly-displaceable internal ring (17) mounted for angular displacement in the opening of the female element (10), the angularly-displaceable internal ring comprising therein an opening (18) being a slot, and wherein the male element (9) of the transmissions (18) of the angularly-displaceable internal ring (17), characterized in that the three male elements (9) of the three transmission and guidance units (9,10) are supported and guided by three respective support elements (13) that are located spaced apart on a common rotatable guide ring (11) that is mounted externally of the scroll plates (7,8) for rotation with the scroll plates about an axis which is parallel to the first and second spindles (3,4) and which is radially offset at the maximum scroll eccentricity, whereby each male element (9) of the three transmission and guidance units (9,10) is supported and guided by its support element (13) on the guide ring (11) during limited movement of the male element (9) in the opening (18) of the angularly-displaceable internal ring (17).

2. The co-rotating scroll machine as claimed in claim 1, wherein the three support elements (13) are located at the outer ends of three equal arms (11A) extending radially outwardly from the rotatable guide ring (11) and disposed in correspondence with the three transmission and guidance units (9,10).

3. The co-rotating scroll machine as claimed in claim 2, wherein the three support elements (13) are terminal parts of elongate members (11B) that project from the outer ends of the three arms (11A) and are disposed parallel to the axis of rotation.

4. The co-rotating scroll machine as claimed in claim 1, wherein the male element (9) of each transmission and guidance unit (9,10) comprises a roller (14) mounted on the end of an elongate member (11B).

5. The co-rotating scroll machine as claimed in claim 1 having three transmission and guidance units (9,10) uniformly distributed at 120° to one another around the scroll plates (7,8) and the guide ring (11) towards the periphery of the scroll plates.

6. The co-rotating scroll machine as claimed in claim 1, wherein the transmission and guidance units (9,10) are located partly in corresponding projections that project from the periphery of generally circular scroll plates (7,8).

7. The co-rotating scroll machine as claimed in claim 1, wherein the female element (10) of each transmission and guidance unit comprises a cylindrical housing (15) attached to one scroll plate (8), in which cylindrical housing (15) said angularly-displaceable internal ring (17) is mounted for angular displacement over an inner cylindrical surface of the cylindrical housing (15).

8. The co-rotating scroll machine as claimed in claim 7, wherein said angularly-displaceable internal ring (17) is mounted in the cylindrical housing (15) by a rotary bearing (16).

9. The co-rotating scroll machine as claimed in claim 1, wherein said angularly-displaceable internal ring (17) is made foraminate to make it lightweight.

10. The co-rotating scroll machine as claimed in claim 9, wherein said angularly-displaceable internal ring (17) comprises a radial-inwardly directed slot (18) extending inside the internal ring from the outer periphery of the internal ring and extending over part or substantially the entire width of the internal ring, said radial-inwardly directed slot (18) being enclosed by a boundary wall integral with the internal ring, the internal ring (17) further comprising a foraminate reinforcing structure occupying the space between the inner periphery of the internal ring and said boundary wall of the radial-inwardly directed slot (18).

11. The co-rotating scroll machine as claimed in claim 1, wherein said openings in the internal angularly-displaceable rings (17) of the three transmission and guidance units are slots (18) and the center-to-center spacing of the scroll plates (7,8) is coordinated with the displacement of the male elements (9) in the slots (18) of the internal rings (17) in the female elements (10) to maintain said internal rings such that their slots (18) all remain parallel to one another during rotation of the scroll plates by the action of the guide ring (11).

12. The co-rotating scroll machine as claimed in claim 1, wherein the three male elements (9) of the three transmission and guidance units comprise rotatably mounted rollers forming rotatable cam followers (14) engaging in the openings (18) of the internal rings (11) in the female elements (10).

13. The co-rotating scroll machine as claimed in claim 1, wherein one scroll plate (7) is built without discharge port and with an internal channel (20) connected on one side to a shaft in spindle (3) and the other side to several bleed holes (21) leading to compression/expansion chambers defined between the scroll plates (7,8), this arrangement enabling a controlled injection of a stream of pressurized liquid inside the chambers during compression and expansion operations to perform 2-phase, almost-isothermal compression/expansion processes.

* * * * *